US006857487B2

(12) United States Patent
Galloway et al.

(10) Patent No.: US 6,857,487 B2
(45) Date of Patent: Feb. 22, 2005

(54) DRILLING WITH CONCENTRIC STRINGS OF CASING

(75) Inventors: Gregory G. Galloway, Conroe, TX (US); David J. Brunnert, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 2 days.

(21) Appl. No.: 10/331,964

(22) Filed: Dec. 30, 2002

(65) Prior Publication Data

US 2004/0124010 A1 Jul. 1, 2004

(51) Int. Cl.[7] ..... E21B 7/20
(52) U.S. Cl. ..... 175/171; 175/22; 166/380
(58) Field of Search ..... 175/171, 22, 57, 175/257, 262; 166/380; 405/253

(56) References Cited

U.S. PATENT DOCUMENTS

| | | | | |
|---|---|---|---|---|
| 1,185,582 A | | 5/1916 | Bignell | |
| 1,301,285 A | | 4/1919 | Leonard | |
| 1,342,424 A | * | 6/1920 | Cotten | 405/253 |
| 1,842,638 A | | 1/1932 | Wigle | |
| 1,880,218 A | | 10/1932 | Simmons | |
| 1,917,135 A | | 7/1933 | Littell | |
| 1,981,525 A | | 11/1934 | Price | |
| 2,017,451 A | | 10/1935 | Wickersham | |
| 2,049,450 A | | 8/1936 | Johnson | |
| 2,060,352 A | | 11/1936 | Stokes | |
| 2,214,429 A | | 9/1940 | Miller | |
| 2,216,895 A | | 10/1940 | Stokes | |
| 2,295,803 A | | 9/1942 | O'Leary | |
| 2,324,679 A | | 7/1943 | Cox | |
| 2,499,630 A | | 3/1950 | Clark | |
| 2,522,444 A | | 9/1950 | Grable | |
| 2,610,690 A | | 9/1952 | Beatty | |
| 2,621,742 A | | 12/1952 | Brown | |
| 2,627,891 A | | 2/1953 | Clark | |

(List continued on next page.)

FOREIGN PATENT DOCUMENTS

| | | |
|---|---|---|
| DE | 3 213 464 | 10/1983 |
| DE | 4 133 802 | 10/1992 |
| EP | 0 235 105 | 9/1987 |

(List continued on next page.)

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23–25, 2000 pp. 1–9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. (1998), pp. 124–130.

(List continued on next page.)

*Primary Examiner*—David Bagnell
*Assistant Examiner*—Daniel P Stephenson
(74) *Attorney, Agent, or Firm*—Moser, Patterson & Sheridan, L.L.P.

(57) ABSTRACT

The present invention provides a method and apparatus for setting concentric casing strings within a wellbore in one run-in of a casing working string. In one aspect of the invention, the apparatus comprises a drilling system comprising concentric casing strings, with each casing string having a drill bit piece disposed at the lower end thereof. The drill bit pieces of adjacent casing strings are releasably connected to one another. In another aspect of the invention, a method is provided for setting concentric casing strings within a wellbore with the drilling system. In another aspect of the invention, the releasably connected drill bit pieces comprise a drill bit assembly.

36 Claims, 8 Drawing Sheets

U.S. PATENT DOCUMENTS

| | | | | | |
|---|---|---|---|---|---|
| 2,641,444 | A | | 6/1953 | Moon | |
| 2,650,314 | A | | 8/1953 | Hennigh et al. | |
| 2,663,073 | A | | 12/1953 | Bieber et al. | |
| 2,668,689 | A | | 2/1954 | Cormany | |
| 2,692,059 | A | | 10/1954 | Bolling, Jr. | |
| 2,738,011 | A | | 3/1956 | Mabry | |
| 2,743,087 | A | | 4/1956 | Layne et al. | |
| 2,743,495 | A | | 5/1956 | Eklund | |
| 2,764,329 | A | | 9/1956 | Hampton | |
| 2,765,146 | A | | 10/1956 | Williams | |
| 2,805,043 | A | | 9/1957 | Williams | |
| 3,087,546 | A | | 4/1963 | Wooley | |
| 3,102,599 | A | | 9/1963 | Hillburn | |
| 3,122,811 | A | | 3/1964 | Gilreath | |
| 3,123,160 | A | | 3/1964 | Kammerer | |
| 3,159,219 | A | | 12/1964 | Scott | |
| 3,169,592 | A | | 2/1965 | Kammerer | |
| 3,191,677 | A | | 6/1965 | Kinley | |
| 3,191,680 | A | | 6/1965 | Vincent | |
| 3,353,599 | A | | 11/1967 | Swift | |
| 3,380,528 | A | | 4/1968 | Timmons | |
| 3,387,893 | A | | 6/1968 | Hoever | |
| 3,392,609 | A | | 7/1968 | Bartos | |
| 3,489,220 | A | | 1/1970 | Kinley | |
| 3,518,903 | A | | 7/1970 | Ham et al. | |
| 3,550,684 | A | | 12/1970 | Cubberly, Jr. | |
| 3,552,508 | A | | 1/1971 | Brown | |
| 3,552,509 | A | | 1/1971 | Brown | |
| 3,552,510 | A | | 1/1971 | Brown | |
| 3,559,739 | A | | 2/1971 | Hutchison | |
| 3,570,598 | A | | 3/1971 | Johnson | |
| 3,575,245 | A | | 4/1971 | Cordary et al. | |
| 3,603,411 | A | | 9/1971 | Link | |
| 3,603,412 | A | | 9/1971 | Kammerer, Jr. et al. | |
| 3,603,413 | A | | 9/1971 | Grill et al. | |
| 3,624,760 | A | * | 11/1971 | Bodine | 175/56 |
| 3,656,564 | A | | 4/1972 | Brown | |
| 3,669,190 | A | | 6/1972 | Sizer et al. | |
| 3,691,624 | A | | 9/1972 | Kinley | |
| 3,692,126 | A | | 9/1972 | Rushing et al. | |
| 3,700,048 | A | * | 10/1972 | Desmoulins | 175/6 |
| 3,729,057 | A | | 4/1973 | Werner | |
| 3,747,675 | A | | 7/1973 | Brown | |
| 3,785,193 | A | | 1/1974 | Kinley et al. | |
| 3,808,916 | A | | 5/1974 | Porter et al. | |
| 3,838,613 | A | | 10/1974 | Wilms | |
| 3,840,128 | A | | 10/1974 | Swoboda, Jr. et al. | |
| 3,870,114 | A | | 3/1975 | Pulk et al. | |
| 3,881,375 | A | | 5/1975 | Kelly | |
| 3,885,679 | A | | 5/1975 | Swoboda, Jr. et al. | |
| 3,901,331 | A | * | 8/1975 | Djurovic | 175/171 |
| 3,934,660 | A | | 1/1976 | Nelson | |
| 3,945,444 | A | * | 3/1976 | Knudson | 175/92 |
| 3,964,556 | A | | 6/1976 | Gearhart et al. | |
| 3,980,143 | A | | 9/1976 | Swartz et al. | |
| 4,049,066 | A | | 9/1977 | Richey | |
| 4,054,426 | A | | 10/1977 | White | |
| 4,064,939 | A | | 12/1977 | Marquis | |
| 4,077,525 | A | | 3/1978 | Callegari et al. | |
| 4,082,144 | A | | 4/1978 | Marquis | |
| 4,083,405 | A | | 4/1978 | Shirley | |
| 4,085,808 | A | | 4/1978 | Kling | |
| 4,100,968 | A | | 7/1978 | Delano | |
| 4,100,981 | A | * | 7/1978 | Chaffin | 175/60 |
| 4,133,396 | A | | 1/1979 | Tschirky | |
| 4,142,739 | A | | 3/1979 | Billingsley | |
| 4,173,457 | A | | 11/1979 | Smith | |
| 4,175,619 | A | | 11/1979 | Davis | |
| 4,186,628 | A | | 2/1980 | Bonnice | |
| 4,189,185 | A | | 2/1980 | Kammerer, Jr. et al. | |
| 4,221,269 | A | | 9/1980 | Hudson | |
| 4,257,442 | A | | 3/1981 | Claycomb | |
| 4,262,693 | A | | 4/1981 | Giebeler | |
| 4,274,777 | A | | 6/1981 | Scaggs | |
| 4,274,778 | A | | 6/1981 | Putnam et al. | |
| 4,281,722 | A | | 8/1981 | Tucker et al. | |
| 4,287,949 | A | | 9/1981 | Lindsey, Jr. | |
| 4,315,553 | A | | 2/1982 | Stallings | |
| 4,320,915 | A | | 3/1982 | Abbott et al. | |
| 4,336,415 | A | | 6/1982 | Walling | |
| 4,384,627 | A | | 5/1983 | Ramirez-Jauregui | |
| 4,396,076 | A | | 8/1983 | Inoue | |
| 4,396,077 | A | | 8/1983 | Radtke | |
| 4,408,669 | A | | 10/1983 | Wiredal | |
| 4,413,682 | A | | 11/1983 | Callihan et al. | |
| 4,440,220 | A | | 4/1984 | McArthur | |
| 4,446,745 | A | | 5/1984 | Stone et al. | |
| 4,460,053 | A | | 7/1984 | Jurgens et al. | |
| 4,463,814 | A | | 8/1984 | Horstmeyer et al. | |
| 4,466,498 | A | | 8/1984 | Bardwell | |
| 4,470,470 | A | | 9/1984 | Takano | |
| 4,472,002 | A | | 9/1984 | Beney et al. | |
| 4,474,243 | A | | 10/1984 | Gaines | |
| 4,483,399 | A | | 11/1984 | Colgate | |
| 4,489,793 | A | | 12/1984 | Boren | |
| 4,515,045 | A | | 5/1985 | Gnatchenko et al. | |
| 4,544,041 | A | | 10/1985 | Rinaldi | |
| 4,545,443 | A | | 10/1985 | Wiredal | |
| 4,580,631 | A | | 4/1986 | Baugh | |
| 4,583,603 | A | | 4/1986 | Dorleans et al. | |
| 4,589,495 | A | | 5/1986 | Langer et al. | |
| 4,595,058 | A | | 6/1986 | Nations | |
| 4,604,724 | A | | 8/1986 | Shaginian et al. | |
| 4,604,818 | A | | 8/1986 | Inoue | |
| 4,605,077 | A | | 8/1986 | Boyadjieff | |
| 4,620,600 | A | | 11/1986 | Persson | |
| 4,630,691 | A | | 12/1986 | Hooper | |
| 4,651,837 | A | | 3/1987 | Mayfield | |
| 4,652,195 | A | | 3/1987 | McArthur | |
| 4,655,286 | A | | 4/1987 | Wood | |
| 4,671,358 | A | | 6/1987 | Lindsey, Jr. et al. | |
| 4,681,158 | A | | 7/1987 | Pennison | |
| 4,686,873 | A | | 8/1987 | Lang et al. | |
| 4,699,224 | A | | 10/1987 | Burton | |
| 4,725,179 | A | | 2/1988 | Woolslayer et al. | |
| 4,735,270 | A | | 4/1988 | Fenyvesi | |
| 4,760,882 | A | | 8/1988 | Novak | |
| 4,762,187 | A | | 8/1988 | Haney | |
| 4,765,416 | A | | 8/1988 | Bjerking et al. | |
| 4,813,495 | A | | 3/1989 | Leach | |
| 4,825,947 | A | | 5/1989 | Mikolajczyk | |
| 4,832,552 | A | | 5/1989 | Skelly | |
| 4,836,299 | A | * | 6/1989 | Bodine | 175/22 |
| 4,842,081 | A | | 6/1989 | Parant | |
| 4,843,945 | A | | 7/1989 | Dinsdale | |
| 4,848,469 | A | | 7/1989 | Baugh et al. | |
| 4,854,386 | A | | 8/1989 | Baker et al. | |
| 4,880,058 | A | | 11/1989 | Lindsey et al. | |
| 4,904,119 | A | | 2/1990 | Legendre et al. | |
| 4,921,386 | A | | 5/1990 | McArthur | |
| 4,960,173 | A | | 10/1990 | Cognevich et al. | |
| 4,962,822 | A | | 10/1990 | Pascale | |
| 4,997,042 | A | | 3/1991 | Jordan et al. | |
| 5,022,472 | A | | 6/1991 | Bailey et al. | |
| 5,027,914 | A | | 7/1991 | Wilson | |
| 5,049,020 | A | | 9/1991 | McArthur | |
| 5,052,483 | A | | 10/1991 | Hudson | |
| 5,060,542 | A | | 10/1991 | Hauk | |
| 5,060,737 | A | | 10/1991 | Mohn | |
| 5,074,366 | A | | 12/1991 | Karlsson et al. | |
| 5,082,069 | A | | 1/1992 | Seiler et al. | |

5,096,465 A 3/1992 Chen et al.
5,109,924 A 5/1992 Jurgens et al.
5,111,893 A 5/1992 Kvello-Aune
5,148,875 A 9/1992 Karlsson et al.
5,160,925 A 11/1992 Dailey et al.
5,168,942 A 12/1992 Wydrinski
5,172,765 A 12/1992 Sas-Jaworsky
5,181,571 A 1/1993 Mueller
5,186,265 A 2/1993 Henson et al.
5,191,939 A 3/1993 Stokley
5,197,553 A 3/1993 Leturno
5,234,052 A 8/1993 Coone et al.
5,255,741 A 10/1993 Alexander
5,255,751 A 10/1993 Stogner
5,271,472 A 12/1993 Leturno
5,282,653 A 2/1994 LaFleur et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,318,122 A 6/1994 Murray et al.
5,320,178 A 6/1994 Cornette
5,322,127 A 6/1994 McNair et al.
5,323,858 A 6/1994 Jones et al.
5,332,048 A 7/1994 Underwood et al.
5,343,950 A 9/1994 Hale et al.
5,343,951 A 9/1994 Cowan et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,402,856 A 4/1995 Warren et al.
5,435,400 A 7/1995 Smith
5,452,923 A 9/1995 Smith
5,456,317 A 10/1995 Hood, III et al.
5,458,209 A 10/1995 Hayes et al.
5,472,057 A * 12/1995 Winfree ..... 175/57
5,477,925 A 12/1995 Trahan et al.
5,497,840 A 3/1996 Hudson
5,520,255 A 5/1996 Barr et al.
5,526,880 A 6/1996 Jordan, Jr. et al.
5,535,824 A 7/1996 Hudson
5,535,838 A 7/1996 Keshavan et al.
5,547,029 A 8/1996 Rubbo et al.
5,551,521 A 9/1996 Vail, III
5,553,679 A 9/1996 Thorp
5,560,437 A 10/1996 Dickel et al.
5,560,440 A 10/1996 Tibbitts
5,575,344 A 11/1996 Wireman
5,582,259 A 12/1996 Barr
5,584,343 A 12/1996 Coone
5,613,567 A 3/1997 Hudson
5,615,747 A 4/1997 Vail, III
5,651,420 A 7/1997 Tibbitts et al.
5,661,888 A 9/1997 Hanslik
5,662,170 A 9/1997 Donovan et al.
5,662,182 A 9/1997 McLeod et al.
5,667,023 A 9/1997 Harrell et al.
5,667,026 A 9/1997 Lorenz et al.
5,706,905 A 1/1998 Barr
5,711,382 A 1/1998 Hansen et al.
5,717,334 A 2/1998 Vail, III et al.
5,720,356 A 2/1998 Gardes
5,732,776 A 3/1998 Tubel et al.
5,735,348 A 4/1998 Hawkins, III
5,743,344 A 4/1998 McLeod et al.
5,746,276 A 5/1998 Stuart
5,785,132 A 7/1998 Richardson et al.
5,785,134 A 7/1998 McLeod et al.
5,787,978 A 8/1998 Carter et al.
5,803,666 A 9/1998 Keller
5,826,651 A 10/1998 Lee et al.
5,828,003 A 10/1998 Thomeer et al.
5,829,520 A 11/1998 Johnson
5,833,002 A 11/1998 Holcombe
5,836,409 A 11/1998 Vail, III
5,839,330 A 11/1998 Stokka
5,839,519 A * 11/1998 Spedale, Jr. ..... 175/57
5,842,530 A 12/1998 Smith et al.
5,845,722 A * 12/1998 Makohl et al. ..... 175/101
5,860,474 A 1/1999 Stoltz et al.
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,908,049 A 6/1999 Williams et al.
5,913,337 A 6/1999 Williams et al.
5,921,285 A 7/1999 Quigley et al.
5,921,332 A * 7/1999 Spedale, Jr. ..... 175/415
5,931,231 A 8/1999 Mock
5,947,213 A 9/1999 Angle et al.
5,950,742 A 9/1999 Caraway
5,957,225 A 9/1999 Sinor
5,971,079 A 10/1999 Mullins
6,000,472 A 12/1999 Albright et al.
6,024,169 A 2/2000 Haugen
6,026,911 A 2/2000 Angle et al.
6,035,953 A * 3/2000 Rear ..... 175/171
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,671 A 6/2000 Cumming et al.
6,098,717 A 8/2000 Bailey et al.
6,119,772 A 9/2000 Pruet
6,135,208 A 10/2000 Gano et al.
6,155,360 A 12/2000 McLeod
6,158,531 A 12/2000 Vail, III
6,170,573 B1 1/2001 Brunet et al.
6,172,010 B1 1/2001 Argillier et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,206,112 B1 3/2001 Dickinson, III et al.
6,216,533 B1 4/2001 Woloson et al.
6,220,117 B1 4/2001 Butcher
6,234,257 B1 5/2001 Ciglenec et al.
6,263,987 B1 7/2001 Vail, III
6,296,066 B1 10/2001 Terry et al.
6,311,792 B1 11/2001 Scott et al.
6,315,051 B1 11/2001 Ayling
6,325,148 B1 12/2001 Trahan et al.
6,343,649 B1 2/2002 Beck et al.
6,357,485 B2 3/2002 Quigley et al.
6,359,569 B2 3/2002 Beck et al.
6,371,203 B2 4/2002 Frank et al.
6,374,924 B1 4/2002 Hanton et al.
6,378,627 B1 4/2002 Tubel et al.
6,378,630 B1 4/2002 Ritorto et al.
6,397,946 B1 6/2002 Vail, III
6,405,798 B1 6/2002 Barrett et al.
6,408,943 B1 6/2002 Schultz et al.

| | | | |
|---|---|---|---|
| 6,412,554 | B1 | 7/2002 | Allen et al. |
| 6,412,574 | B1 | 7/2002 | Wardley et al. |
| 6,419,014 | B1 | 7/2002 | Meek et al. |
| 6,419,033 | B1 | 7/2002 | Hahn et al. |
| 6,427,776 | B1 | 8/2002 | Hoffman et al. |
| 6,443,241 | B1 | 9/2002 | Juhasz et al. |
| 6,443,247 | B1 | 9/2002 | Wardley |
| 6,457,532 | B1 | 10/2002 | Simpson |
| 6,464,004 | B1 | 10/2002 | Crawford et al. |
| 6,484,818 | B2 | 11/2002 | Alft et al. |
| 6,497,280 | B2 | 12/2002 | Beck et al. |
| 6,527,047 | B1 | 3/2003 | Pietras |
| 6,527,064 | B1 | 3/2003 | Hallundbaek |
| 6,536,520 | B1 | 3/2003 | Snider et al. |
| 6,536,993 | B2 | 3/2003 | Strong et al. |
| 6,538,576 | B1 | 3/2003 | Schultz et al. |
| 6,543,552 | B1 | 4/2003 | Metcalfe et al. |
| 6,547,017 | B1 | 4/2003 | Vail, III |
| 6,554,064 | B1 | 4/2003 | Restarick et al. |
| 6,591,471 | B1 | 7/2003 | Hollingsworth et al. |
| 6,634,430 | B2 | 10/2003 | Dawson et al. |
| 6,668,937 | B1 | 12/2003 | Murray |
| 6,702,040 | B1 | 3/2004 | Sensenig |
| 6,742,606 | B2 | 6/2004 | Metcalfe et al. |
| 2001/0000101 | A1 | 4/2001 | Lovato et al. |
| 2001/0002626 | A1 | 6/2001 | Frank et al. |
| 2001/0013412 | A1 | 8/2001 | Tubel |
| 2001/0040054 | A1 | 11/2001 | Haugen et al. |
| 2001/0042625 | A1 | 11/2001 | Appleton |
| 2001/0047883 | A1 | 12/2001 | Hanton et al. |
| 2002/0040787 | A1 | 4/2002 | Cook et al. |
| 2002/0066556 | A1 | 6/2002 | Goode et al. |
| 2002/0074127 | A1 | 6/2002 | Birckhead et al. |
| 2002/0074132 | A1 | 6/2002 | Juhasz et al. |
| 2002/0079102 | A1 | 6/2002 | Dewey et al. |
| 2002/0134555 | A1 | 9/2002 | Allen et al. |
| 2002/0157829 | A1 | 10/2002 | Davis et al. |
| 2002/0162690 | A1 | 11/2002 | Hanton et al. |
| 2002/0189806 | A1 | 12/2002 | Davidson et al. |
| 2002/0189863 | A1 | 12/2002 | Wardley |
| 2003/0034177 | A1 | 2/2003 | Chitwood et al. |
| 2003/0056991 | A1 | 3/2003 | Hahn et al. |
| 2003/0070841 | A1 | 4/2003 | Merecka et al. |
| 2003/0111267 | A1 | 6/2003 | Pia |
| 2003/0141111 | A1 | 7/2003 | Pia |
| 2003/0146023 | A1 | 8/2003 | Pia |
| 2003/0217865 | A1 | 11/2003 | Simpson et al. |
| 2003/0221519 | A1 | 12/2003 | Haugen et al. |
| 2004/0003490 | A1 | 1/2004 | Shahin et al. |
| 2004/0069501 | A1 | 4/2004 | Haugen et al. |
| 2004/0112603 | A1 | 6/2004 | Galloway et al. |
| 2004/0118614 | A1 | 6/2004 | Galloway et al. |
| 2004/0124010 | A1 | 7/2004 | Galloway et al. |
| 2004/0124011 | A1 | 7/2004 | Gledhill et al. |

FOREIGN PATENT DOCUMENTS

| | | | |
|---|---|---|---|
| EP | 0 265 344 | 4/1988 | |
| EP | 0 462 618 | 12/1991 | |
| EP | 0 554 568 | 8/1993 | |
| EP | 0 571 045 | 8/1998 | ..... E21B/7/06 |
| EP | 0 961 007 | 12/1999 | |
| EP | 1 006 260 | 6/2000 | |
| EP | 1 050 661 | 11/2000 | ..... E21B/7/18 |
| FR | 2053088 | 7/1970 | |
| GB | 540 027 | 10/1941 | |
| GB | 7 928 86 | 4/1958 | |
| GB | 8 388 33 | 6/1960 | |
| GB | 9 977 21 | 7/1965 | |
| GB | 1 277 461 | 6/1972 | |
| GB | 1 448 304 | 9/1976 | |
| GB | 1 469 661 | 4/1977 | |
| GB | 1 582 392 | 1/1981 | |
| GB | 2 053 088 | 2/1981 | |
| GB | 2 201 912 | 9/1988 | |
| GB | 2 216 926 | 10/1989 | |
| GB | 2 313 860 | 2/1997 | |
| GB | 2 320 270 | 6/1998 | |
| GB | 2 333 542 | 7/1999 | |
| GB | 2 335 217 | 9/1999 | |
| GB | 2 348 223 | 9/2000 | |
| GB | 2 357 101 | 6/2001 | ..... E21B/7/06 |
| GB | 2 365 463 | 2/2002 | |
| GB | 2 382 361 | 5/2003 | |
| SU | 112631 | 1/1956 | |
| SU | 659260 | 4/1967 | |
| SU | 247162 | 5/1967 | |
| SU | 395557 | 12/1971 | |
| SU | 415346 | 3/1972 | |
| SU | 481669 | 6/1972 | |
| SU | 461218 | 4/1973 | |
| SU | 501139 | 12/1973 | |
| SU | 585266 | 7/1974 | |
| SU | 583278 | 8/1974 | |
| SU | 601390 | 1/1976 | |
| SU | 581238 | 2/1976 | |
| SU | 655843 | 3/1977 | |
| SU | 781312 | 3/1978 | |
| SU | 899820 | 6/1979 | |
| SU | 955765 | 2/1981 | |
| SU | 1304470 | 8/1984 | |
| SU | 1618870 | 1/1991 | ..... E21B/33/14 |
| SU | 1808972 | 5/1991 | |
| WO | WO 90/06418 | 6/1990 | |
| WO | WO 91/16520 | 10/1991 | |
| WO | WO 92/01139 | 1/1992 | |
| WO | WO 92/18743 | 10/1992 | |
| WO | WO 92/20899 | 11/1992 | |
| WO | WO 93/24728 | 12/1993 | |
| WO | WO 95/10686 | 4/1995 | |
| WO | WO 96/28635 | 9/1996 | |
| WO | WO 97/08418 | 3/1997 | ..... E21B/4/18 |
| WO | WO 98/09053 | 3/1998 | |
| WO | WO 98/55730 | 12/1998 | ..... E21B/23/00 |
| WO | WO 99/11902 | 3/1999 | |
| WO | WO 99/23354 | 5/1999 | |
| WO | WO 99/37881 | 7/1999 | |
| WO | WO 99/50528 | 10/1999 | |
| WO | WO 99/64713 | 12/1999 | |
| WO | WO 00/05483 | 2/2000 | ..... E21B/19/16 |
| WO | WO 00/08293 | 2/2000 | |
| WO | WO 00/11309 | 3/2000 | ..... E21B/19/16 |
| WO | WO 00/11310 | 3/2000 | ..... E21B/19/16 |
| WO | WO 00/11311 | 3/2000 | ..... E21B/19/16 |
| WO | WO 00/28188 | 5/2000 | ..... E21B/7/06 |
| WO | WO 00/37766 | 6/2000 | |
| WO | WO 00/37771 | 6/2000 | ..... E21B/43/10 |
| WO | WO 00/50730 | 8/2000 | ..... E21B/10/66 |
| WO | WO 01/12946 | 2/2001 | ..... E21B/19/00 |
| WO | WO 01/46550 | 6/2001 | ..... E21B/7/20 |
| WO | WO 01/79650 | 10/2001 | ..... E21B/10/60 |
| WO | WO 01/81708 | 11/2001 | ..... E21B/10/32 |
| WO | WO 01/83932 | 11/2001 | |
| WO | WO 01/94738 | 12/2001 | ..... E21B/7/20 |
| WO | WO 01/94739 | 12/2001 | ..... E21B/7/20 |
| WO | WO 02/086287 | 10/2002 | ..... E21B/47/01 |

OTHER PUBLICATIONS

"First Success with Casing–Drilling" Word Oil, Feb. (1999), pp. 25.

Dean E. Gaddy, Editor, "Russia Shares Technical Know–How with U.S." Oil & Gas Journal, Mar. (1999), pp. 51–52 and 54–56.

U.S. Appl. No. 10/794,800, filed Mar. 5, 2004 (WEAT/0360).
U.S. Appl. No. 10/832,804, filed Apr. 27, 2004 (WEAT/0383.P1).
U.S. Appl. No. 10/795,214, filed Mar. 5, 2004 (WEAT/0373).
U.S. Appl. No. 10/794,795, filed Mar. 5, 2004 (WEAT/0357).
U.S. Appl. No. 10/775,048, filed Feb. 9, 2004 (WEAT/0359).
U.S. Appl. No. 10/772,217, filed Feb. 2, 2004 (WEAT/0344).
U.S. Appl. No. 10/788,976, filed Feb. 27, 2004 (WEAT/0372).
U.S. Appl. No. 10/794,797, filed Mar. 5, 2004 (WEAT/0371).
U.S. Appl. No. 10/767,322, filed Jan. 29, 2004 (WEAT/0343).
U.S. Appl. No. 10/795,129, filed Mar. 5, 2004 (WEAT/0366).
U.S. Appl. No. 10/794,790, filed Mar. 5, 2004 (WEAT/0329).
U.S. Appl. No. 10/162,302, filed Jun. 4, 2004 (WEAT/0410).
Rotary Steerable Technology—Technology Gains Momentum, Oil & Gas Journal, Dec. 28, 1998.
Directional Drilling, M. Mims, World Oil, May 1999, pp. 40–43.
Multilateral Classification System w/Example Applications, Alan MacKenzie & Cliff Hogg, World Oil, Jan. 1999, pp. 55–61.
Tarr, et al., "Casing–while–Drilling: The Next Step Change In Well Construction," World Oil, Oct. 1999, pp. 34–40.
De Leon Mojarro, "Breaking A Paradigm: Drilling with Tubin Gas Wells," SPE Paper 40051, SPE Annual Technical Conference And Exhibition, Mar. 3–5, 1998, pp. 465–472.
De Leon Mojarro, "Drilling/Completing With Tubing Cuts Well Costs by 30%," World Oil, Jul. 1998, pp. 145–150.
Littleton, "Refined Slimhole Drilling Technology Renews Operator Interest," Petroleum Engineer International, Jun. 1992, pp. 19–26.
Anon, "Slim Holes Fat Savings," Journal of Petroleum Technology, Sep. 1992, pp. 816–819.
Anon, "Slim Holes, Slimmer Prospect," Journal of Petroleum Technology, Nov. 1995, pp. 949–952.
Vogt, et al., "Drilling Liner Technology For Depleted Reservoir," SPE Paper 36827, SPE Annual Technical Conference And Exhibition, Oct. 22–24, pp. 127–132.
Mojarro, et al., "Drilling/Completing With Tubing Cuts Well Costs by 30%," World Oil, Jul. 1998, pp. 145–150.
Sinor, et al., Rotary Liner Drilling For Depleted Reservoirs, IADC/SPE Paper 39399, IADC/SPE Drilling Conference, Mar. 3–6, 1998, pp. 1–13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9–11, 1999, pp. 221–229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineering International, Apr. 1999, p. 15.
Laurent, et al., "A New Generation Drilling Rig: Hydraulically Powered And Computer Controlled," CADE/CAODC Paper 99–120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99–121, CADE/CAODC Spring Drilling Conference, Apr. 7 & 8, 1999, pp. 1–12.
Tessari, et al., "Focus: Drilling With Casing Promises Major Benefits," Oil & Gas Journal, May 17, 1999, pp. 58–62.
Laurent, et al., "Hydraulic Rig Supports Casing Drilling," World Oil, Sep. 1999, pp. 61–68.
Perdue, et al., "Casing Technology Improves," Hart's E & P, Nov. 1999, pp. 135–136.
Warren, et al., "Casing Drilling Application Design Considerations," IADC/SPE Paper 59179, IADC/SPE Drilling Conference, Feb. 23–25, 2000 pp. 1–11.
Warren, et al., "Drilling Technology: Part 1—Casing Drilling With Directional Steering In The U.S. Gulf Of Mexico," Offshore, Jan. 2001, pp. 50–52.
Warren, et al., "Drilling Technology; Part II—Casing Drilling With Directional Steering In The Gulf Of Mexico," Offshore, Feb. 2001, pp. 40–42.
Shepard, et al., "Casing Drilling: An Emerging Technology," IADC/SPE Paper 67731, SPE/IADC Drilling Conference, Feb. 27–Mar. 1, 2001, pp. 1–13.
Editor, "Tesco Finishes Field Trial Program," Drilling Contractor, Mar./Apr. 2001, p. 53.
Warren, et al., "Casing Drilling Technology Moves To More Challenging Application," AADE Paper 01–NC–HO–32, AADE National Drilling Conference, Mar. 27–29, 2001, pp. 1–10.
Shephard, et al., "Casing Drilling: An Emerging Technology," SPE Drilling & Completion, Mar. 2002, pp. 4–14.
Shephard, et al., "Casing Drilling Successfully Applied In Southern Wyoming," World Oil, Jun. 2002, pp. 33–41.
Forest, et al., "Subsea Equipment For Deep Water Drilling Using Dual Gradient Mud System," SPE/IADC Drilling Conference, Amsterdam, The Netherlands, Feb. 27, 2001–Mar. 01, 2001, 8 pages.
World's First Drilling With Casing Operation From A Floating Drilling Unit, Sep. 2003, 1 page.
Fillippov, et al., "Expandable Tubular Solutions," SPE paper 56500, SPE Annual Technical Conference And Exhibition, Oct. 3–6, 1999, pp. 1–16.
Coronado, et al., "Development Of A One–Trip ECP Cement Inflation And Stage Cementing System For Open Hole Completions," IADC/SPE Paper 39345, IADC/SPE Drilling Conference, Mar. 3–6, 1998, pp. 473–481.
Coronado et al., "A One–Trip External–Casing–Packer Cement–Inflation And Stage–Cementing System," Journal Of Petroleum Technology, Aug. 1998, pp. 76–77.
Quigley, "Coiled Tubing And Its Applications," SPE Short Course, Houston, Texas, Oct. 3, 1999, 9 pages.
Bayfiled, et al., "Burst And Collapse Of A Sealed Mutilateral Junction: Numerical Simulations," SPE/IADC Paper 52873, SPE/IADC Drilling Conference, Mar. 9–11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5–6, 2000, pp. 1–9.

Cales, et al., Subsidence Remediation—Extending Well Life Through The Use Of Solid Expandable Casing Systems, AADE Paper 01–NC–HO–24, American Association Of Drilling Engineers, Mar. 2001 Conference, pp. 1–16.
Coats, et al., "The Hybrid Drilling Unite: An Overview of an Integrated Composite Coiled Tubing And Hydraulic Workover Drilling System," SPE Paper 74349, SPE International Petroleum Conference And Exhibition, Feb. 10–12, 2002, pp. 1–7.
Sander, et al., "Project Management And Technology Provide Enhanced Performance For Shallow Horizontal Wells," IADC/SPE Paper 74466, IADC/SPE Drilling Conference, Feb. 26–28, 2002, pp. 1–9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26–28, 2002, pp. 1–7.
Galloway, "Rotary Drilling With Casing—A Field Proven Method Of Reducing Wellbore Construction Cost," Paper WOCD–0306092, World Oil Casing Drilling Technical Conference, Mar. 6–7, 2003, pp. 1–7.
Fontenot, et al., "New Rig Design Enhances Casing Drilling Operations In Lobo Trend," paper WOCD–0306–04, World Oil Casing Drilling Technical Conference, Mar. 6–7, 2003, pp. 1–13.
McKay, et al., "New Developments In The Technology Of Drilling With Casing: Utilizing A Displaceable DrillShoe Tool," Paper WOCD–0306–05, World Oil Casing Drilling Technical Conference, Mar. 6–7, 2003, pp. 1–11.
Sutriono—Santos, et al., "Drilling With Casing Advances To Floating Drilling Unit With Surface BOP Employed," Paper WOCD–0307–01, World Oil Casing Drilling Technical Conference, Mar. 6–7, 2003, pp. 1–7.
Vincent, et al., "Linear And Casing Drilling—Case Histories And Technology," Paper WOCD–0307–02, World Oil Casing Drilling Technical Conference, Mar. 6–7, 2003, pp. 1–20.
Maute, "Electrical Logging: State–of–the Art," the Log Analyst, May–Jun. 1992, pp. 206–227.
Tessari, et al., "Retrievable Tools Provide Flexibility for Casing Drilling," Paper No. WOCD–0306–01, World Oil Casing Drilling Technical Conference, 2003, pp. 1–11.
Evans, et al., "Development And Testing Of An Economical Casing Connection For Use in Drilling Operations," paper WOCD–0306–03, World Oil Casing Drilling Technical Conference, Mar. 6–7, 2003, pp. 1–10.

* cited by examiner

DRILLING WITH CONCENTRIC STRINGS OF CASING

BACKGROUND OF THE INVENTION

1. Field of the Invention

The present invention relates to methods and apparatus for forming a wellbore in a well. More specifically, the invention relates to methods and apparatus for forming a wellbore by drilling with casing. More specifically still, the invention relates to drilling a well with drill bit pieces connected to concentric casing strings.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

In some drilling operations, such as deepwater well completion operations, a conductor pipe is initially placed into the wellbore as a first string of casing. A conductor pipe is the largest diameter pipe that will be placed into the wellbore. The top layer of deepwater wells primarily consists of mud; therefore, the conductor pipe often may merely be pushed downward into the wellbore rather than drilled into the wellbore. To prevent the mud from filling the interior of the conductor pipe, it is necessary to jet the pipe into the ground by forcing pressurized fluid through the inner diameter of the conductor pipe concurrent with pushing the conductor pipe into the wellbore. The fluid and the mud are thus forced to flow upward outside the conductor pipe, so that the conductor pipe remains essentially hollow to receive casing strings of decreasing diameter, as described below.

It is common to employ more than one string of casing in a wellbore. In this respect, the well is drilled to a first designated depth with a drill bit on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever-decreasing diameter.

As more casing strings are set in the wellbore, the casing strings become progressively smaller in diameter in order to fit within the previous casing string. In a drilling operation, the drill bit for drilling to the next predetermined depth must thus become progressively smaller as the diameter of each casing string decreases in order to fit within the previous casing string. Therefore, multiple drill bits of different sizes are ordinarily necessary for drilling in well completion operations.

Well completion operations are typically accomplished using one of two methods. The first method involves first running the drill string with the drill bit attached thereto into the wellbore to concentrically drill a hole in which to set the casing string. The drill string must then be removed. Next, the casing string is run into the wellbore on a working string and set within the hole within the wellbore. These two steps are repeated as desired with progressively smaller drill bits and casing strings until the desired depth is reached. For this method, two run-ins into the wellbore are required per casing string that is set into the wellbore.

The second method of performing well completion operations involves drilling with casing, as opposed to the first method of drilling and then setting the casing. In this method, the casing string is run into the wellbore along with a drill bit for drilling the subsequent, smaller diameter hole located in the interior of the casing string. In a deepwater drilling operation, the conductor pipe includes a drill bit upon run-in of the first casing string which only operates after placement of the conductor pipe by the above described means. The drill bit is operated by concentric rotation of the drill string from the surface of the wellbore. After the conductor pipe is set into the wellbore, the first drill bit is then actuated to drill a subsequent, smaller diameter hole. The first drill bit is then retrieved from the wellbore. The second working string comprises a smaller casing string with a second drill bit in the interior of the casing string. The second drill bit is smaller than the first drill bit so that it fits within the second, smaller casing string. The second casing string is set in the hole that was drilled by the first drill bit on the previous run-in of the first casing string. The second, smaller drill bit then drills a smaller hole for the placement of the third casing upon the next run-in of the casing string. Again the drill bit is retrieved, and subsequent assemblies comprising casing strings with drill bits in the interior of the casing strings are operated until the well is completed to a desired depth. This method requires at least one run-in into the wellbore per casing string that is set into the wellbore.

Both prior art methods of well completion require several run-ins of the casing working string and/or drill string to place subsequent casing strings into the wellbore. Each run-in of the strings to set subsequent casing within the wellbore is more expensive, as labor costs and equipment costs increase upon each run-in. Accordingly, it is desirable to minimize the number of run-ins of casing working strings and/or drill strings required to set the necessary casing strings within the wellbore to the desired depth.

Furthermore, each run-in of the drill string and/or casing string requires attachment of a different size drill bit to the drill string and/or casing string. Again, this increases labor and equipment costs, as numerous drill bits must be purchased and transported and labor must be utilized to attach the drill bits of decreasing size.

Therefore, a need exists for a drilling system that can set multiple casing strings within the wellbore upon one run-in of the casing working string. Drilling with multiple casing strings temporarily attached concentrically to each other increases the amount of casing that can be set in one run-in of the casing string. Moreover, a need exists for a drill bit assembly which permits drilling with one drill bit for subsequent strings of casing of decreasing diameter. One embodiment of the drilling system of the present invention employs a drilling assembly with one drill bit comprising drill bit pieces releasably connected. Thus, one drill bit is used to drill holes of decreasing diameter within the wellbore for setting casing strings of decreasing diameter. In consequence, operating costs incurred in a well completion operation are correspondingly decreased.

SUMMARY OF THE INVENTION

The present invention discloses a drilling system comprising concentric strings of casing having drill bit pieces connected to the casing, and a method for using the drilling system. In one embodiment, the concentric strings of casing are temporarily connected to one another. In another embodiment, the drill bit pieces are temporarily connected to one another form a drill bit assembly.

In one aspect of the present invention, the drilling system comprises concentric strings of casing with decreasing diameters located within each other. A conductor pipe or outermost string of casing comprises the outer casing string of the system. Casing strings of ever-decreasing diameter are located in the hollow interior of the conductor pipe. The drilling system further comprises drill bit pieces connected to the bottom of each casing string. The drill bit pieces are releasably connected to one another so that they form a drill bit assembly and connect the casing strings to one another.

Located on the outermost casing string on the uppermost portion of the casing string of the drilling system are hangers connected atop the outermost casing string or conductor pipe which jut radially outward to anchor the drilling assembly to the top of the wellbore. These hangers prevent vertical movement of the outermost casing string and secure the drilling system upon run-in of the casing string. The drilling assembly is made up of drill bit pieces with cutting structures, where the drill bit pieces are releasably connected to each other. The outermost, first drill bit piece is connected to the conductor pipe and juts radially outward and downward into the wellbore from the conductor pipe. A smaller, first casing string then contains a similar second drill bit piece which is smaller than the first drill bit piece. As many drill bits pieces and casing strings as are necessary to complete the well may be placed on the run-in string. The innermost casing string contains a drill bit piece that juts outward and downward from the casing string and also essentially fills the inner diameter of the innermost casing string. The drill bit piece disposed at the lower end of the innermost casing string contains perforations within it which allow some fluid flow downward through the innermost casing string. The drill bit pieces are releasably connected to each other by progressively stronger force as the casing string diameters become smaller. In other words, the outer connections between drill bit pieces are weaker than the inner connections between drill bit pieces. A working casing string is temporarily connected to the inner diameter of the innermost casing string of the drilling system by a threadable connection or tong assembly. Fluid and/or mud may be pumped into the working casing string during the drilling operation. The working casing string permits rotational force as well as axial force to be applied to the drilling system from the surface during the drilling operation.

In another aspect of the invention, the drilling system comprises concentric strings of casing. The concentric strings of casing comprise a conductor pipe or outermost string of casing and casing strings of ever-decreasing diameter within the hollow interior of the conductor pipe. The drilling system further comprises at least one drill bit piece disposed at the lower end of the outermost string of casing. The concentric strings of casing are releasably connected to one another.

In operation, the drilling system is lowered into the wellbore on the working casing string. In some cases, the drilling system is rotated by applying rotational force to the working casing string from the surface of the well. However, as described above, in some deepwater drilling operations, drilling into the well by rotation of the working string is not necessary because the formation is soft enough that the drilling system may merely be pushed downward into the formation to the desired depth when setting the conductor pipe. Pressurized fluid is introduced into the working casing string while the drilling system is lowered into the wellbore. When the drilling system is lowered to the desired depth, the downward movement and/or rotational movement stops. A cementing operation is then conducted to fill the annular space between the wellbore and the conductor pipe. Next, a downward force is asserted on the working casing string from the surface of the wellbore. The downward force is calculated to break the connection between the drill bit piece of the conductor pipe and the drill bit piece of the first casing string. In the alternative embodiment, the force breaks the connection between the conductor pipe and the first string of casing. The conductor pipe remains cemented in the previously drilled hole with its drill bit piece attached to it, while the rest of the drilling system falls downward due to the pressure placed on the assembly. In the alternative embodiment, the conductor pipe remains cemented in the previously drilled hole while the entire drill bit piece falls downward with the remainder of the drilling system. This process is repeated until enough casing strings are placed in the wellbore to reach the desired depth. The innermost casing string retains the final remaining portion of the drill bit assembly. In the alternative embodiment, the entire drill bit piece is retained on the innermost casing string.

The drilling system of the present invention and the method for using the drilling system allow multiple strings of casing to be set within the wellbore with only one run-in of the casing working string. The drill bit assembly of the present invention permits drilling of multiple holes of decreasing diameter within the wellbore with only one run-in of the drilling system. Furthermore, the drilling system of the present invention uses one drill bit assembly rather than requiring running in of a drill string or casing working string for each drill bit piece of decreasing diameter to drill holes in which to place casing strings of decreasing diameter. Therefore, operating and equipment costs in a well completion operation using the drilling system with the drilling assembly are decreased.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
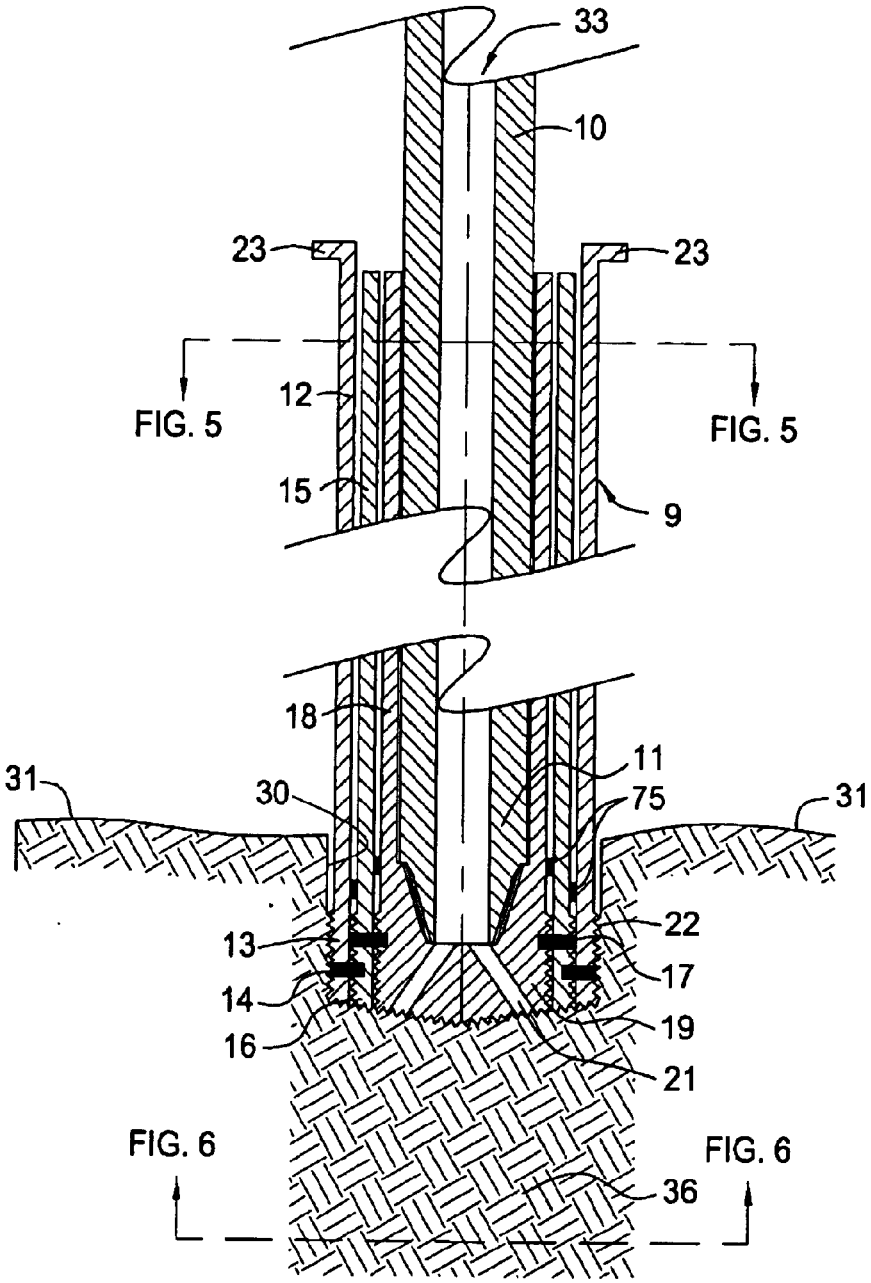
FIG. 1 is a cross-sectional view of one embodiment of the drilling system of the present invention in the run-in configuration.
Figure 5:
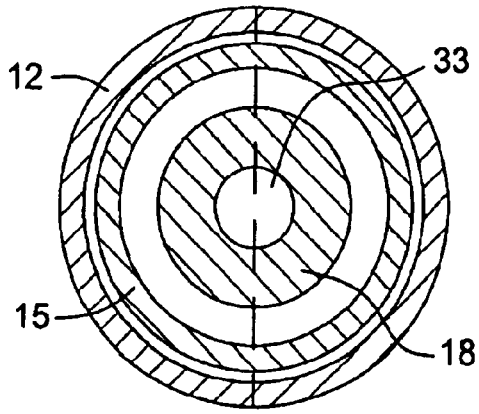
FIG. 5 is a top section view of the concentric casing strings of the present invention, taken along line 5—5 of FIG. 1.

FIG. 1 is a cross-sectional view of one embodiment of the drilling system 9 of the present invention in the run-in configuration. The drilling system 9 comprises three concentric strings of casing, including a conductor pipe 12, a first casing string 15, and a second casing string 18. The conductor pipe 12 has a larger diameter than the first casing string 15, and the first casing string 15 has a larger diameter than the second casing string 18. Thus, the second casing string 18 is located within the first casing string 15, which is located within the conductor pipe 12. Although the drilling system 9 depicted in FIG. 1 comprises three casing strings, any number of concentric strings of casing may be used in the drilling system 9 of the present invention. Optionally, the drilling system 9 comprises wipers 75 disposed in the annular space between the conductor pipe 12 and the first casing string 15 and/or disposed in the annular space between the first casing string 15 and the second casing string 18. The wipers 75 prevent unwanted solids from migrating into the annular spaces between casing strings and debilitating the operation of the drill bit assembly, which is discussed below. FIG. 5, which is taken along line 5—5 of FIG. 1, shows the upper portion of the concentric strings of casing in a top section view.

Figure 6:
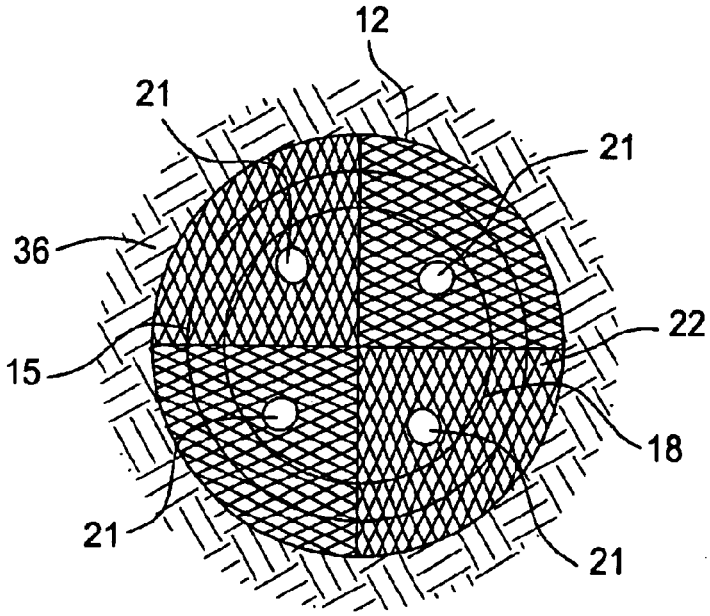
FIG. 6 is a top section view of the drilling system of the present invention, taken along line 6—6 of FIG. 1.

A first drill bit piece 13 is disposed at the lower end of the conductor pipe 12. In like manner, a second drill bit piece 16 is disposed at the lower end of the first casing string 15, and a third drill bit piece 19 is disposed at the lower end of the second casing string 18. Although the drilling system 9 in FIG. 1 shows three casing strings with three drill bit pieces attached thereto, any number of drill bit pieces may be attached to any number of concentric strings of casing in the drilling system 9 of the present invention. The first drill bit piece 13 and second drill bit piece 16 jut outward and downward from the conductor pipe 12 and the first casing string 15, respectively. The drill bit pieces 13, 16, and 19 possess cutting structures 22, which are used to form a path for the casing through a formation 36 during the drilling operation. The cutting structures 22 are disposed on drill bit pieces 13, 16, and 19 on the lower end and the outside portion of each drill bit piece. The innermost casing string, in this case the second casing string 18, comprises a third drill bit piece 19 which juts outward and downward from the second casing string 18 and which also essentially fills the inner diameter of the second casing string 18. Perforations 21 are formed within the third drill bit piece 19 through which fluid may flow during the well completion operation. FIG. 6, which is taken along line 6—6 of FIG. 1, represents a top section view of the drilling system 9, which shows the perforations 21.

FIG. 6 represents a top section view of the drilling system 9 of the present invention, which comprises concentric casing strings 12, 15, and 18 with a drill bit assembly attached thereupon. The drill bit assembly is described in reference to FIG. 1 as well as FIG. 6. The drill bit assembly comprises a first drill bit piece 13 releasably connected to a second drill bit piece 16 by a first connector 14. The assembly further comprises a third drill bit piece 19 releasably connected to the second drill bit piece 16 by a second connector 17. The releasable connections are preferably shearable connections, wherein the first connector 14 holds the first drill bit piece 13 to the second drill bit piece 16 with less force than the second connector 17 holds the second drill bit piece 16 to the third drill bit piece 19. The first drill bit piece 13, the second drill bit piece 16, and the third drill bit piece 19 are located on the lower ends of concentric casing strings 12, 15, and 18, respectively.

The first, second and third drill bit pieces, 13, 16, and 19 respectively, possess cutting structures 22 on their outer and bottom surfaces. As described below, after the first drill bit piece 13 is released from the drill bit assembly, the cutting structures 22 on the outer surface of the second drill bit piece 16 are employed to drill through the formation 36 to a depth to set the first casing string 15. Similarly, after the second drill bit piece 16 is released from the drill bit assembly, the cutting structures 22 on the outer surface of the third drill bit piece 19 are employed to drill through the formation 36 to a depth to set the second casing string 18.

As illustrated in FIG. 1, the drilling system 9 also comprises hangers 23, which are located on the upper end of the conductor pipe 12. The hangers 23 maintain the drilling system 9 in place by engaging the surface 31 of the wellbore 30, preventing the drilling system 9 from experiencing further downward movement through the formation 36. Any member suitable for supporting the weight of the drilling system 9 may be used as a hanger 23.

A casing working string 10 is connected to the inner diameter of the second casing string 18. Any type of connection which produces a stronger force than the force produced by the connectors 14 and 17 may be used with the present invention. FIG. 1 shows a type of connection suitable for use with the present invention. A threadable connection 11 is shown between the casing working string 10 and the second casing string 18 which is unthreaded after the drilling operation is completed so that the casing working string 10 may be retrieved. Alternatively, the casing working string 10 may be shearably connected to the second casing string 18 by a tong assembly (not shown). The force produced by the shearable connection of the tong assembly must be greater than the force produced by the connectors 14 and 17. The tong assembly is connected to the lower end of the casing working string 10 and extends radially through the annular space between the casing working string 10 and the inner diameter of the second casing string 18. Upon completion of the drilling operation, the shearable connection is broken by a longitudinal force so that the casing working string 10 may be retrieved from the wellbore 30.

In the drilling system 9, the first drill bit piece 13 is releasably connected to the second drill bit piece 16 by the first connector 14. Similarly, the second drill bit piece 16 is releasably connected to the third drill bit piece 19 by the second connector 17. The releasable connection is preferably a shearable connection. The first connector 14 and the second connector 17 are any connectors capable of temporarily connecting the two drill bit pieces, including weight sheared pins or locking mechanisms. In the embodiment described above, the longitudinal force required to break the connection between the tong assembly and the second casing string 18 is more than the longitudinal force required to break the second connector 17. In the same way, the longitudinal force required to break the second connector 17 is more than the longitudinal force required to break the first connector 14. Accordingly, the connection between the tong assembly and the second casing string 18 is stronger than the second connector, and the connection produced by the second connector 17 is stronger than the connection produced by the first connector 14.

The annular space between casing strings 12 and 15, as well as the annular space between casing strings 15 and 18, may comprise sealing members 70 to prevent migration of unwanted fluid and solids into the annular spaces until the designated point in the drilling operation. The sealing members 70 prevent fluid flow into the annular spaces, thus forcing setting fluid to flow into the desired area outside of the casing string being set. The sealing members 70 are released along with their respective connectors 14 and 17 at the designated step in the operation.

Figure 7:
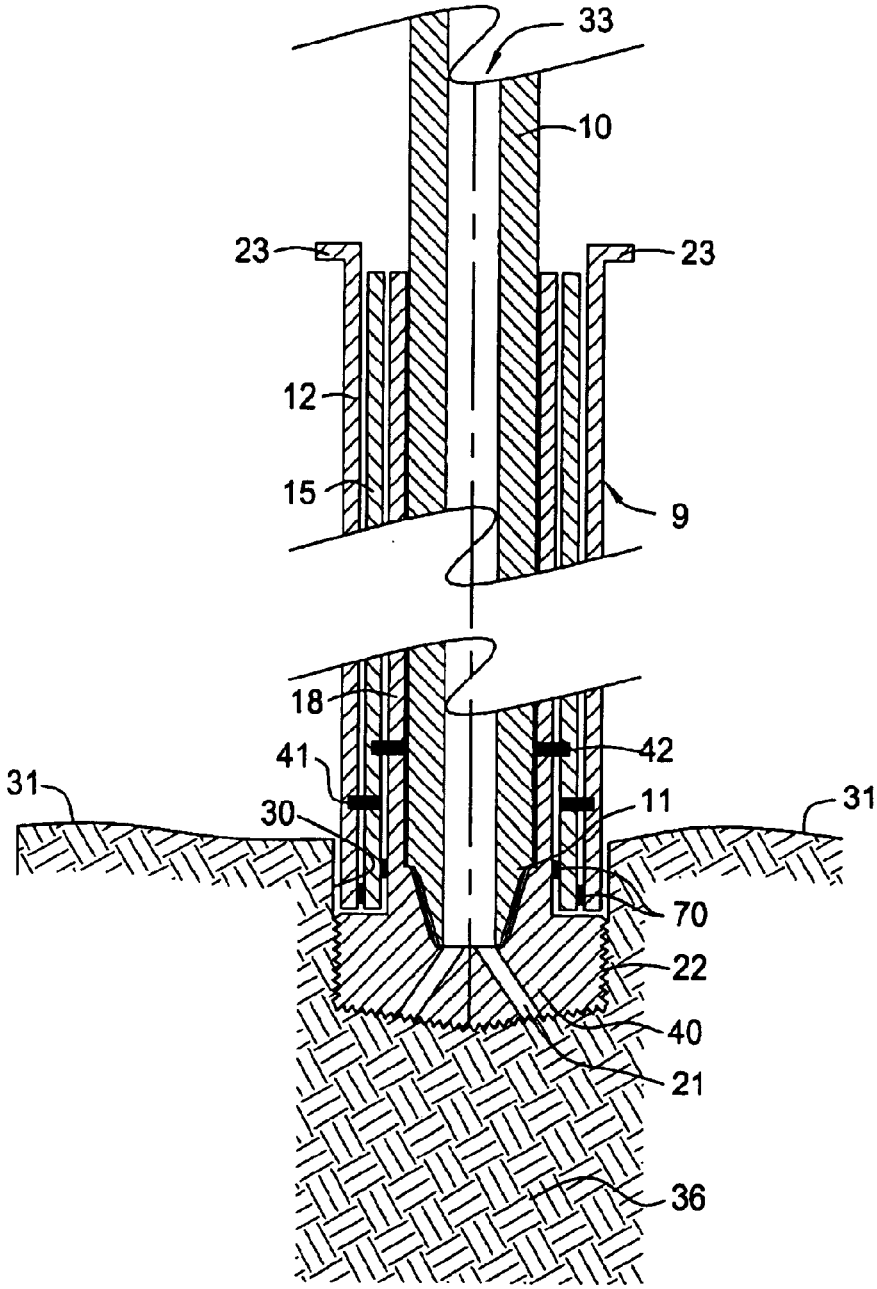
FIG. 7 is a cross-sectional view of an alternative embodiment of the drilling system of the present invention in the run-in configuration.

FIG. 7 shows an alternative embodiment of the drilling system 9 of the present invention in the run-in configuration. In this embodiment, the drilling system 9 is identical to the drilling system of FIG. 1 except for the connectors of the drilling system 9 and the drill bit pieces. The numbers used to identify parts of FIG. 1 correspond to the numbers used to identify the same parts of FIG. 7. In the embodiment of FIG. 7, one drill bit piece 40 is disposed at the lower end of the innermost casing string, which is the second casing string 18. Again, any number of concentric casing strings may be employed in the present invention. The drill bit piece 40 comprises perforations 21 which run therethrough and allow fluid flow through the casing working string 10 and into the formation 36. A first connector 41 releasably connects the conductor pipe 12 to the first string of casing 15. Similarly, a second connector 42 releasably connects the first string of casing 15 to the second string of casing 18. The releasable connection is preferably a shearable connection created by either weight sheared pins or locking mechanisms. The force required to release the second connector 42 is greater than the force required to release the first connector 41. Likewise, the force created by the threadable connection 11 or tong assembly (not shown) is greater than the force required to release the second connector 42.

Figure 8A:
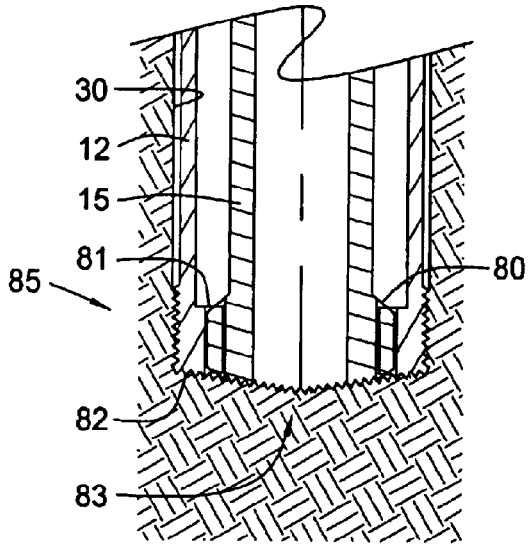
FIGS. 8 A–B are cross-sectional views of a drilling system having a torque key system.
Figure 8B:
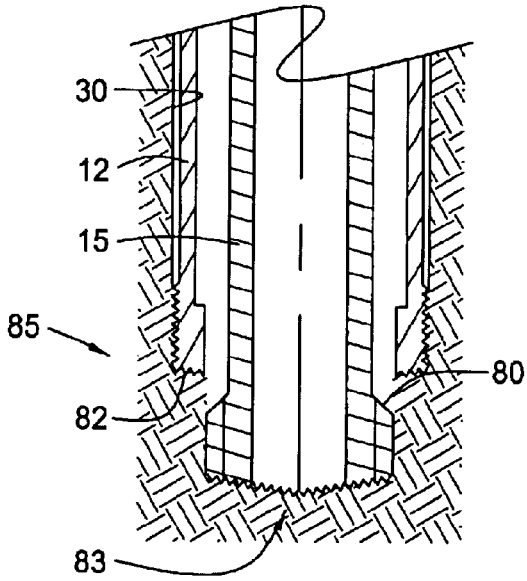

In a further alternative embodiment, the drilling system 9 may employ a torque key system 85, as illustrated in FIGS. 8 A–B. A torque key system 85 comprises keys 80 located on the inner casing string 15 of the concentric strings of casing which engage slots 81 formed in the outer casing string 12 of the concentric strings of casing. The drill bit pieces 13, 16, and 19 of FIG. 1 and 40 of FIG. 7 comprise a cutting structure 83 located above an inverted portion 82 of the casing strings 12 and 15. The first torque key system 85 comprises keys 80 disposed on the first casing string 15 and slots 81 disposed on the conductor pipe 12. When the drilling system 9 is used to drill to the desired depth within the formation 36 to set the conductor pipe 12, the keys 80 disposed on the first casing string 15 remain engaged within the slots 81 disposed in the conductor pipe 12, thus restricting rotational movement of the first casing string 15 relative to the conductor pipe 12 so that the first casing string 15 and the conductor pipe 12 translate together. After the drilling system 9 has drilled to the desired depth within the wellbore 30, the key 80 on the first casing string 15 is released from the slot 81 in the conductor pipe 12, thereby allowing rotational as well as longitudinal movement of the first casing string 15 relative to the conductor pipe 12. Next, the inverted portion of the conductor pipe 12 is milled off by the cutting structure 83 located above the inverted portion 82 of the conductor pipe 12 so that the drill bit piece 16 may operate to drill to the second designated depth within the wellbore 30 while the second torque key system of the first casing string 15 and the second casing string 18 remains engaged. The second torque key system operates in the same way as the first torque key system.

Figure 9:
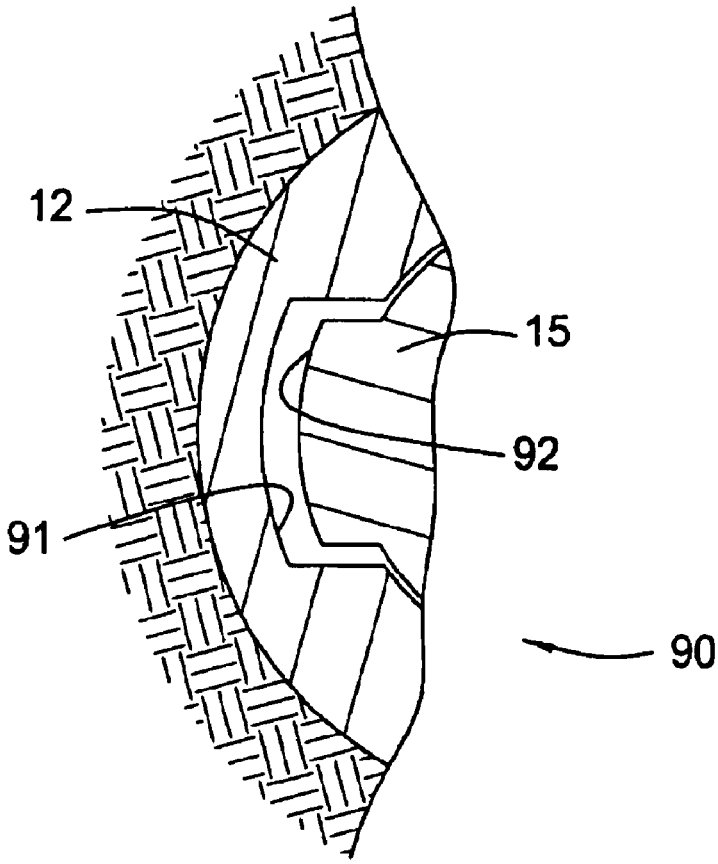
FIG. 9 is a partial cross-sectional view of a drilling system having a spline and groove connection according to aspects of the present invention.

In a further embodiment, a spline connection 90 may be utilized in place of the torque key system to restrict rotational movement of the conductor pipe 12 relative to the first casing string 15. FIG. 9 is a partial cross-sectional view of the spline and groove connection 90 according to aspects of the present invention. In this embodiment, the conductor pipe 12 and the first casing string 15 possess a spline connection 90. The spline connection 90 comprises grooves 91 formed on an inner surface of the conductor pipe 12 which mate with splines formed on an outer surface of the first casing string 15. The spline, when engaged, allows the first casing string 15 and the conductor pipe 12 to translate rotationally together when the drilling system 9 is drilled to the desired depth, while at the same time allowing the first casing string 15 and the conductor pipe 12 to move axially relative to one another. When the releasable connection between the first casing string 15 and the conductor pipe 12 is released, the two casing strings 12 and 15 are permitted to rotate relative to one another. A second spline connection (not shown) may also be disposed on the first casing string 15 and the second casing string 18.

Figure 2:
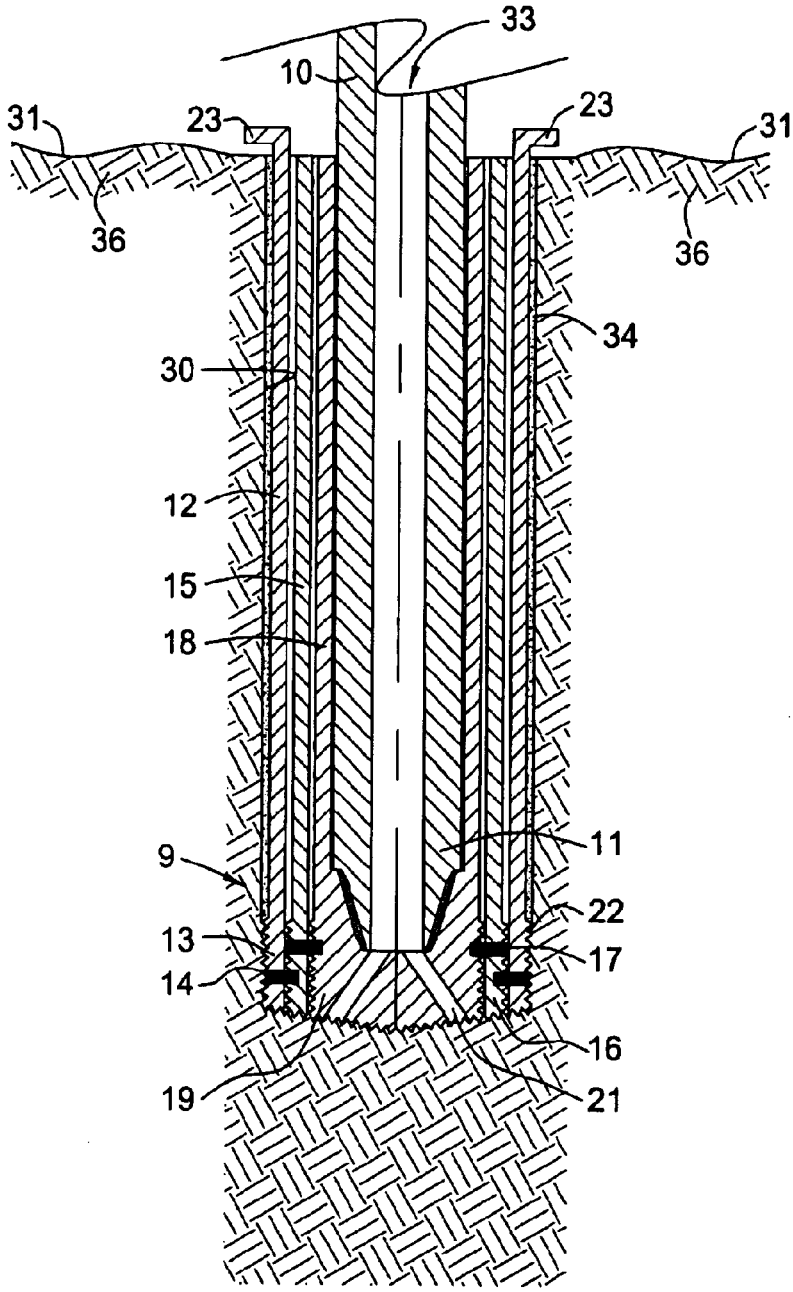
FIG. 2 is a cross-sectional view of the drilling system of FIG. 1 disposed in a wellbore after the drilling system is run into a desired depth within the wellbore, with a conductor pipe set within the wellbore.
Figure 3:
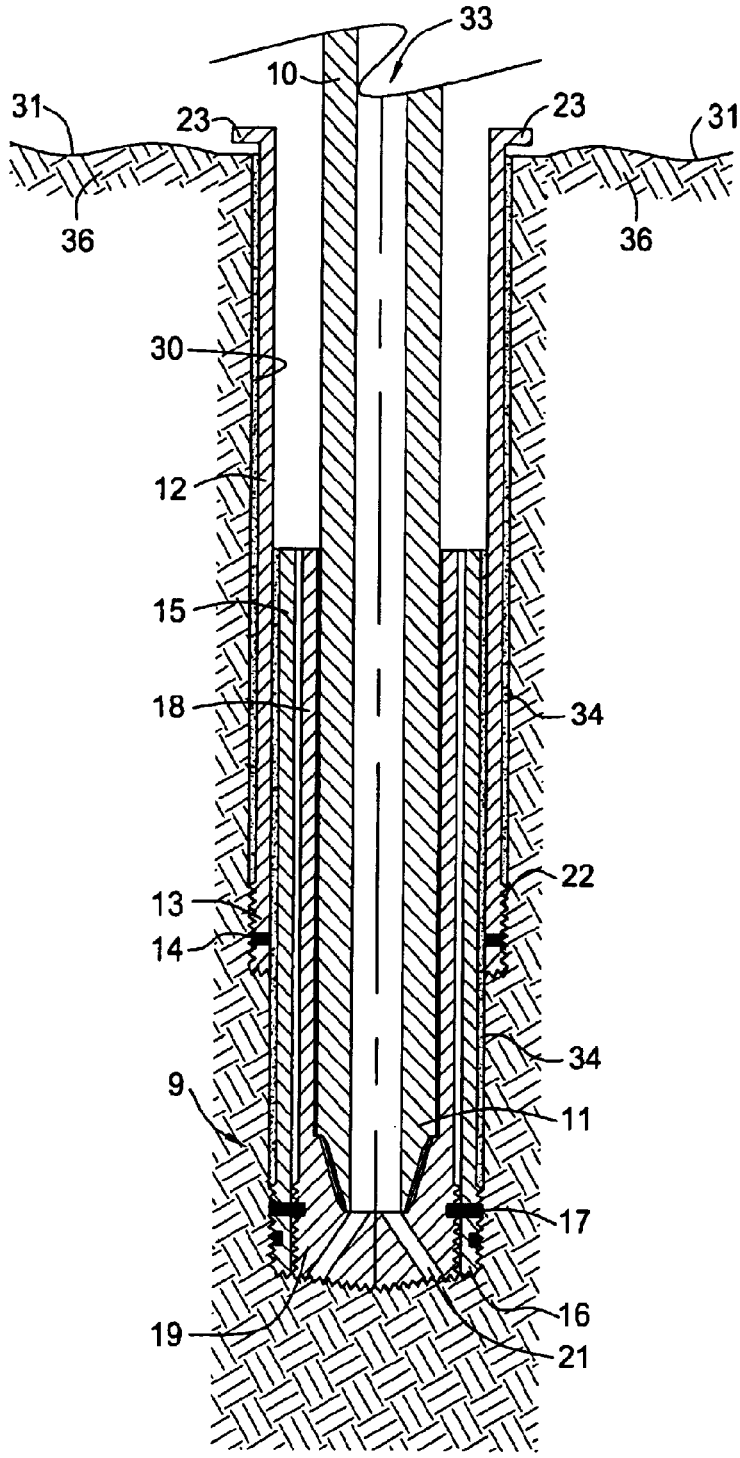
FIG. 3 is a cross-sectional view of the drilling system of FIG. 1 disposed in a wellbore, with the conductor pipe and a first casing string set within the wellbore.
Figure 4:
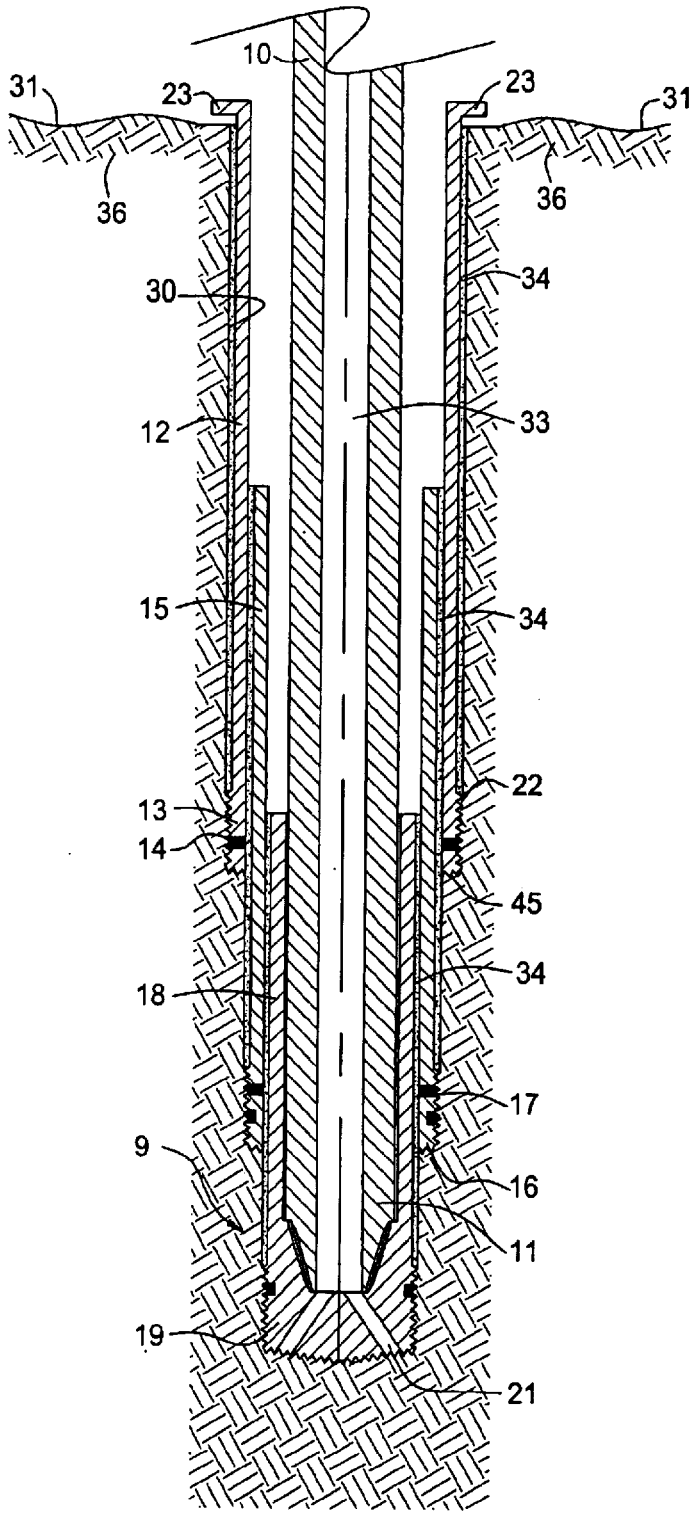
FIG. 4 is a cross-sectional view of the drilling system of FIG. 1 disposed in a wellbore, with the conductor pipe, the first casing string, and the second casing string set within the wellbore.

FIGS. 2, 3, and 4 depict the first embodiment of the drilling system 9 of FIG. 1 in operation. FIG. 2 is a cross-sectional view of the drilling system 9 of the present invention disposed in a wellbore 30, with the conductor pipe 12 set within the wellbore 30. FIG. 3 is a cross-sectional view of the drilling system 9 of the present invention disposed in a wellbore 30, with the conductor pipe 12 and the first casing string 15 set within the wellbore 30. FIG. 4 is a cross-sectional view of the drilling system 9 of the present invention disposed in a wellbore 30, with the conductor pipe 12, the first casing string 15, and the second casing string 18 set within the wellbore 30.

In operation, the drilling system 9 is connected to the casing working string 10 running therethrough. As shown in FIGS. 1 and 7, the casing working string 10 with the drilling system 9 connected is run into a wellbore 30 within the formation 36. While running the casing working string 10 into the wellbore 30, a longitudinal force and a rotational force are applied from the surface 31 upon the casing working string 10. Alternatively, if the formation 36 is sufficiently soft such as in deepwater drilling operations, only a longitudinal force is necessary to run the drilling system 9 into the desired depth within the wellbore 30 to set the conductor pipe 12. Pressurized fluid is introduced into the bore 33 of the casing working string 10 concurrently with running the casing working string 10 into the wellbore 30 so that the fluid and mud that would ordinarily flow upward through the inner diameter of the casing working string 10 are forced to flow upward through the annular space between the conductor pipe 12 and the wellbore 30.

As shown in FIG. 2, when the entire length of the conductor pipe 12 is run into the wellbore 30 so that the hangers 23 apply pressure upon the surface 31, the longitudinal force and/or rotational force exerted on the casing working string 10 is halted. A cementing operation is then conducted in order to fill an annular area between the wellbore 30 and the conductor pipe 12 with cement 34. Alternatively, if the friction of the wellbore 30 is sufficient to hold the conductor pipe 12 in place, a cementing operation is not necessary. FIG. 2 shows the conductor pipe 12 set within the wellbore 30.

Subsequently, a first longitudinal force is applied to the casing working string 10 from the surface 31. The first longitudinal force breaks the releasable connection between the first drill bit piece 13 and the second drill bit piece 16 that is formed by the first connector 14. Rotational force and longitudinal force are again applied to the casing working string 10 from the surface 31. The remainder of the drilling system 9 exerts rotational and longitudinal force on the formation 36 so that a deeper hole is formed within the wellbore 30 for setting the first casing string 15. This hole is necessarily smaller in diameter than the first hole formed because the drill bit assembly is missing the first drill bit piece 13 and is therefore of decreased diameter. Pressurized fluid is introduced into the bore 33 of the casing working string 10 concurrently with running the drilling system 9 further downward into the wellbore 30 so that the fluid and mud that would ordinarily flow upward through the inner diameter of the casing working string 10 are forced to flow upward in the annular space between the outer diameter of the first casing string 15 and the inner diameter of the conductor pipe 12.

As shown in FIG. 3, when the first casing string 15 is drilled to the desired depth within the wellbore 30, the longitudinal and rotational forces applied on the casing working string 10 are again halted. A cementing operation is then conducted in order to fill an annular area between the conductor pipe 12 and the first casing string 15 with cement 34. FIG. 3 shows the first casing string 15 along with the conductor pipe 12 set within the wellbore 30.

In the next step of the drilling operation, a second longitudinal force is applied to the casing working string 10 from the surface 31. This second longitudinal force is greater than the first longitudinal force, as the second longitudinal force must apply enough pressure to the casing working string 10 to break the releasable connection between the second drill bit piece 16 and the third drill bit piece 19 formed by the second connector 17. Longitudinal and rotational forces are again applied to the remaining portion of the drilling system 9 so that the formation 36 is drilled to the desired depth by the remaining portion of the drill bit assembly. Again, pressurized fluid is run into the bore 33 in the casing working string 10 from the surface 31 concurrent with the rotational and longitudinal force to prevent mud and fluid from traveling upward through the casing working string 10. The mud and fluid introduced into the casing working string 10 exit the system by flowing upward to the surface 31 through the annular space between the first casing string 15 and the second casing string 18. The hole that is formed by the remaining portion of the drilling system 9 is even smaller than the previous hole drilled by the drilling system 9 to set the first casing string 15 because the second drill bit piece 16 has released from the drill bit assembly, thus further decreasing the diameter of the drill bit assembly.

As shown in FIG. 4, when the drilling system 9 has been drilled into the formation 36 to the desired depth to set the second casing string 18, the longitudinal and rotational forces are again halted. A cementing operation is then conducted in order to fill an annular area between the first casing string 15 and the second casing string 18 with cement 34, thus setting the second casing string 18. The completed operation is shown in FIG. 4.

At the end of the drilling operation, the remainder of the drilling system 9, which comprises the third drill bit piece 19 and the second casing string 18, permanently resides in the wellbore 30. The threadable connection 11 is disconnected from the inner diameter of the second casing string 18, and the casing working string 10 and the threadable connection 11 are removed from the wellbore 30.

The second embodiment depicted in FIG. 7 works in much the same way as the first embodiment of the present invention, with minor differences. Instead of using longitudinal force to release the connectors 14 and 17 between the drill bit pieces, the force is used to release the connectors 41 and 42 between the concentric strings of casing 12, 15, and 18. A first longitudinal force is used to break the first connector 41 between the conductor pipe 12 and the first casing string 15. A second, greater longitudinal force is used to break the second connector 42 between the first string of casing 15 and the second string of casing 18. Finally, the threadable connection 11 is unthreaded after the drilling operation is completed so that the casing working string 10 may be retrieved. Alternatively, a third, even greater longitudinal force may used to break the shearable connection between the tong assembly (not shown) and the second casing string 18. Because drill bit pieces are not disposed at the lower end of casing strings 12 and 15, drill bit pieces are not left within the wellbore during the course of the operation, but remain attached to the drilling system 9 until the final stage. The drill bit piece 40 is carried with the second casing string 18 during the entire operation and remains attached to the second string of casing 18 within the wellbore upon completion of the drilling operation. In any of the embodiments described above, the connectors 14 and 17 or the connectors 41 and 42 may alternatively comprise an assembly which is removable from the surface using wireline, tubing, or drill pipe at the end of drilling operation. Furthermore, the connectors 14 and 17 and the connectors 41 and 42 may comprise an assembly that may be de-activated from the surface 31 of the wellbore 30 by pressure within the casing strings 12, 15, and 18.

An alternate method (not shown) of setting the casing strings 12, 15, and 18 within the wellbore 30 involves using any of the above methods to drill the casing strings 12, 15, and 18 to the desired depth within the wellbore 30. However, instead of conducting a cementing operation at each stage in the operation after each casing string has reached its desired depth within the wellbore 30, each of the casing strings 12, 15, and 18 are lowered to the final depth of the entire drilling system 9 (as shown in FIG. 4). FIG. 4 is used for illustrative purposes in the description below, although other embodiments of the drilling system 9 described above may be used to accomplish this alternative method. The drilling system 9 is lowered to the desired depth for setting the conductor pipe 12 by rotational and longitudinal forces. Then, the rotational force is halted and the longitudinal force is utilized to release the first connector 14. The conductor pipe 12 is fixed longitudinally and rotationally within the wellbore 30 by the portion 45 of the formation 36 which extends beyond the remaining portion of the drilling system 9. The remaining portion of the drilling system 9 which comprises the first string of casing 15 and the second casing string 18 is drilled to the second desired depth within the wellbore 30, and the process is repeated until the entire drilling system 9 has telescoped to the desired depth within the wellbore 30. Then, a cementing operation is conducted to set all of the casing strings 12, 15, and 18 within the wellbore 30 at the same time.

While the foregoing is directed to embodiments of the present invention, other and further embodiments of the invention may be devised without departing from the basic scope thereof, and the scope thereof is determined by the claims that follow.

What is claimed is:

1. A method for setting at least two strings of casing within a wellbore, the at least two strings of casing comprising a second string of casing disposed within a first string of casing, comprising:

running a casing working string into the wellbore, the casing working string comprising:

the at least two strings of casing releasably connected to one another; and a drill bit piece disposed at the lower end of at least one of the at least two strings of casing;

setting the first string of casing within the wellbore;

releasing the releasable connection between the first string of casing and the second string of casing;

running the casing working string into the wellbore to a second depth while applying rotational force to the drill bit piece; and setting the second string of casing within the wellbore.

2. The method of claim 1, further comprising disconnecting the casing working string from the strings of casing and retrieving the casing working string from the wellbore.

3. The method of claim 1, further comprising introducing pressurized fluid into the casing working string while running the casing working string into the wellbore to a first depth and while running the casing working string into the wellbore to the second depth.

4. The method of claim 1, wherein setting the strings of casing comprises introducing setting fluid into an annular area between the wellbore and the string of casing which is being set.

5. The method of claim 1, wherein a setting fluid is introduced into an annular area between the wellbore and the strings of casing only after the casing working string is run into the wellbore to the second depth.

6. The method of claim 1, wherein the rotational force is discontinued before setting the strings of casing within the wellbore.

7. The method of claim 1, wherein the rotational force is supplied by a top drive motor or a rotary table at a surface of the wellbore.

8. A method for setting at least three strings of casing within a wellbore, the at least three strings of casing comprising a second string of casing disposed within a first string of casing and a third string of casing disposed within the second string of casing, comprising:

running a casing working string into the wellbore while applying rotational force to the casing working string, the casing working string comprising:

the at least three strings of casing; and drill bit pieces disposed at the lower end of each string of casing, the drill bit pieces releasably connected to each other;

setting the first string of casing within the wellbore;

applying a first force to break the releasable connection between the first string of casing and the second string of casing;

running the casing working string into the wellbore to a second depth while applying rotational force to the casing working string;

setting the second string of casing within the wellbore;

applying a second force to break the releasable connection between the second string of casing and the third string of casing;

running the casing working string into the wellbore to a third depth while applying rotational force to the casing working string; and setting the third string of casing within the wellbore.

9. The method of claim 8, further comprising disconnecting the casing working string from the at least three strings of casing and retrieving the casing working string from the wellbore.

10. The method of claim 8, further comprising introducing pressurized fluid into the casing working string while running the casing working string into the wellbore to a first depth, while running the casing working string to a second depth, and while running the casing working string into the wellbore to a third depth.

11. The method of claim 8, wherein setting the at least three strings of casing comprises introducing setting fluid into an annular area between the wellbore and the string of casing which is being set.

12. The method of claim 8, wherein a setting fluid is introduced into an annular area between the wellbore and the at least three strings of casing only after the casing working string is run into the wellbore to the third depth.

13. The method of claim 8, wherein the rotational force is discontinued before setting the at least three strings of casing within the wellbore.

14. The method of claim 8, wherein the rotational force is supplied by a top drive motor or a rotary table at a surface of the wellbore.

15. The method of claim 8, wherein the second force is greater than the first force.

16. A method of drilling with casing comprising:

forming a first section of wellbore with a first casing string, the first casing string having a bore forming member at a lower end thereof; and forming a second section of wellbore with a second casing string, the second casing string selectively extending telescopically from the lower end of the first casing string, wherein first section of wellbore has a larger diameter than the second section of wellbore.

17. A drilling system for setting concentric casing strings within a wellbore, comprising:

at least three strings of casing concentrically disposed;

a connector releasably connecting each adjacent strings of casing; and a drill bit piece disposed at the lower end of at least one of the at least three strings of casing, wherein the force required to release the connectors increases as the diameter of the strings of casing decreases.

18. A drilling system for setting concentric casing strings within a wellbore, comprising:

at least three strings of casing concentrically disposed;

a connector releasably connecting each adjacent strings of casing; and a drill bit piece disposed at the lower end of at least one of the at least three strings of casing, wherein the connectors comprises an assembly that can be deactivated from the surface of the wellbore by establishing sufficient pressure within the casing strings.

19. A drilling system for setting concentric casing strings within a wellbore, comprising:

at least two strings of casing, wherein the outer diameter of the inner string of casing is smaller than the inner diameter of the outer string of casing;

a drill bit piece disposed at the lower end of at least one of the at least two strings of casing;

a connector which releasably connects adjacent casing strings; and a wiper disposed between the at least two strings of casing.

20. A drilling system for setting concentric casing strings within a wellbore, comprising:

at least two strings of casing, wherein the outer diameter of the inner string of casing is smaller than the inner diameter of the outer string of casing;

a drill bit piece disposed at the lower end of at least one of the at least two strings of casing;

a connector which releasably connects adjacent casing strings; and a torque key system, wherein the torque key system prevents rotational translation of the at least two strings of casing relative to one another.

21. A drilling system for setting concentric casing strings within a wellbore, comprising:

at least two strings of casing, wherein the outer diameter of the inner string of casing is smaller than the inner diameter of the outer string of casing;

a drill bit piece disposed at the lower end of at least one of the at least two strings of casing;

a connector which releasably connects adjacent casing strings; and a spline assembly, wherein the spline assembly prevents rotational translation of the at least two strings of casing relative to one another.

22. A drilling system for setting concentric casing strings within a wellbore, comprising:

an inner string of casing concentrically disposed within an outer string of casing;

a connector for releasably connecting the inner string to the outer string;

a first drilling member connected to the inner string; and a circumferential drilling member connected to the outer string, wherein the drilling members are separable when the inner string is released from the outer string.

23. The drilling system of claim 22, further comprising a third string of casing concentrically disposed adjacent to at least one of the inner string or outer string of casings.

24. The drilling system of claim 23, wherein the third string of casing comprises a second circumferential drilling member.

25. The drilling system of claim 23, further comprising a second releasable connector for connecting the third string of casing to the drilling assembly.

26. The drilling system of claim 25, wherein a force required to release the connectors increases as the diameter of the strings of casing decreases.

27. The drilling system of claim 25, wherein the connectors comprise an assembly removable from the wellbore.

28. The drilling system of claim 23, wherein the connectors comprise an assembly that can be deactivated from the surface of the wellbore by establishing sufficient pressure within the casing strings.

29. The drilling system of claim 22, wherein at least one of the drilling members comprise perforations for fluid flow therethrough.

30. The drilling system of claim 22, further comprising a hanger disposed on the upper end of the outer string of casing, wherein the hanger supports the weight of the drilling system from a surface of the wellbore.

31. The drilling system of claim 22, further comprising a conveying member releasably connected to an inner diameter of the inner string of casing.

32. The drilling system of claim 22, wherein the connector comprises a weight sheared pin or locking mechanism.

33. The drilling system of claim 22, further comprising a sealing member disposed between the inner string of casing and the outer string of casing.

34. The drilling system of claim 22, further comprising a wiper disposed between the inner string and outer string of casing.

35. The drilling system of claim 22, further comprising a torque key system, wherein the torque key system prevents rotational translation of the two strings of casing relative to one another.

36. The drilling system of claim 22, further comprising a spline assembly, wherein the spline assembly prevents rotational translation of the two strings of casing relative to one another.

* * * * *